US008962093B2

(12) United States Patent
Johnston

(10) Patent No.: US 8,962,093 B2
(45) Date of Patent: Feb. 24, 2015

(54) SPRAY PAINT APPLICATION SYSTEM AND METHOD OF USING SAME

(71) Applicant: Matthew L. Johnston, Toms River, NJ (US)

(72) Inventor: Matthew L. Johnston, Toms River, NJ (US)

(73) Assignee: Milspray LLC, Lakewood, NJ (US)

( * ) Notice: Subject to any disclaimer, the term of this patent is extended or adjusted under 35 U.S.C. 154(b) by 218 days.

(21) Appl. No.: 13/647,850

(22) Filed: Oct. 9, 2012

(65) Prior Publication Data

US 2014/0134343 A1 May 15, 2014

Related U.S. Application Data

(63) Continuation-in-part of application No. 13/065,179, filed on Mar. 16, 2011, now abandoned, and a continuation-in-part of application No. 13/065,178, filed on Mar. 16, 2011, and a continuation-in-part of application No. 13/135,281, filed on Jun. 30, 2011, now abandoned.

(60) Provisional application No. 61/456,100, filed on Nov. 1, 2010.

(51) Int. Cl.

| | |
|---|---|
| ***B05B 15/00*** | (2006.01) |
| ***B05D 1/02*** | (2006.01) |
| ***B65B 31/02*** | (2006.01) |

(52) U.S. Cl.

CPC ..... *B05B 15/003* (2013.01); *B05D 1/02* (2013.01); *B65B 31/025* (2013.01)

USPC ..... 427/427; 427/421.1; 239/142; 29/428

(58) Field of Classification Search

USPC ..... 427/421.1, 427; 239/142; 29/428

See application file for complete search history.

(56) References Cited

U.S. PATENT DOCUMENTS

| | | | |
|---|---|---|---|
| 1,096,797 | A | 5/1914 | Snelling |
| 1,207,703 | A | 12/1916 | Basehore et al. |
| 1,738,863 | A | 12/1929 | Bragdon |
| 1,887,969 | A | 11/1932 | Tracy |
| 2,083,028 | A | 6/1937 | Livar |
| 2,392,804 | A | 1/1946 | Basolo |
| 2,529,249 | A | 11/1950 | Flood |
| 3,087,707 | A | 4/1963 | Moonan |

(Continued)

OTHER PUBLICATIONS

Wikipedia, "Spray Nozzle" May 3, 2012.

(Continued)

*Primary Examiner* — Nathan T Leong

(74) *Attorney, Agent, or Firm* — Jeffrey C. Lew

(57) ABSTRACT

A portable, manually operable, trigger-activated pump spray applicator can be used to apply paints and coating fluids in commercial and military end use applications, especially chemical agent resistant coating (CARC) fluids. The applicator includes an impermeable, preferably rigid-walled, container capped by a manually operable spray pump with a single fluid nozzle. The assembly has capability of producing an atomized spray of viscous coating fluids. The applicator includes internal agitators suitable to redisperse solid components of the coating fluid that settle after long-term storage. The agitators include a plurality of small, heavy spheres and a single large, heavy, striker. The inside bottom wall and side wall meet with a concave radius of curvature that matches the radius of the small spheres. The striker has a characteristic dimension of about 10-500% greater than the diameter of the small spheres.

7 Claims, 2 Drawing Sheets

(56) References Cited

U.S. PATENT DOCUMENTS

| | | | | |
|---|---|---|---|---|
| 3,211,324 | A | 10/1965 | Sapien | |
| 3,247,640 | A | 4/1966 | DeWayne et al. | |
| 3,710,538 | A | 1/1973 | Lowy et al. | |
| 4,382,685 | A | 5/1983 | Pearson | |
| 4,533,515 | A | 8/1985 | Witter et al. | |
| 4,641,974 | A | 2/1987 | Church | |
| 4,815,193 | A | 3/1989 | Gutnik | |
| 5,098,193 | A | 3/1992 | Christensen et al. | |
| 5,178,841 | A | 1/1993 | Vokins et al. | |
| 5,236,262 | A * | 8/1993 | Espey | 366/130 |
| 5,328,725 | A * | 7/1994 | Sato et al. | 427/156 |
| 5,829,648 | A * | 11/1998 | Goeren et al. | 222/321.7 |
| 5,974,664 | A | 11/1999 | Stein | |
| 6,183,224 | B1 | 2/2001 | Conatser | |
| 6,322,000 | B1 * | 11/2001 | Scarpa et al. | 239/112 |
| 6,629,402 | B1 | 10/2003 | Zawalick | |
| 6,769,572 | B1 | 8/2004 | Cullotta | |
| 7,198,205 | B1 * | 4/2007 | Solomon et al. | 239/337 |
| 7,338,227 | B2 | 3/2008 | Bullivant | |
| 7,581,654 | B2 | 9/2009 | Stowitts | |
| 7,685,796 | B2 | 3/2010 | Capelli et al. | |
| 8,182,762 | B2 | 5/2012 | Guasch | |
| 8,235,712 | B1 | 8/2012 | Lewis | |
| 2003/0025002 | A1 | 2/2003 | Hughes | |
| 2004/0140373 | A1 | 7/2004 | Joseph et al. | |
| 2005/0247804 | A1 | 11/2005 | Douglas et al. | |
| 2006/0000927 | A1 | 1/2006 | Ruda | |
| 2008/0149216 | A1 * | 6/2008 | Speck | 141/3 |
| 2008/0237370 | A1 | 10/2008 | Turnbull et al. | |
| 2010/0233146 | A1 | 9/2010 | McDaniel | |
| 2010/0252580 | A1 | 10/2010 | Bredbenner | |
| 2011/0240064 | A1 | 10/2011 | Wales et al. | |

OTHER PUBLICATIONS

N. Dutta, et al., Stoving paint from *Mesua ferrea* L. seed oil based short oil polyester and MF resins blend,Progress in Organic Coatings 58 (2007) 40-45.

U.S. Department of Defense, MIL-DTL-53072C Detail Specification Chemical Agent Resistant Coating (CARC) System Application Procedures and Quality Control Inspection Jun. 3, 2003.

* cited by examiner

SPRAY PAINT APPLICATION SYSTEM AND METHOD OF USING SAME

FIELD OF THE INVENTION

This invention relates to an apparatus for spraying a paint or similar polymeric coating onto a substrate. More specifically, it relates to a portable, manually operable pump spraying apparatus having plural, freely moving internal balls to agitate a viscous coating composition.

BACKGROUND OF THE INVENTION

Spray application of paints and functional coating materials onto surfaces of articles is a very well developed and industrially important activity. Very basically, the coating materials to be sprayed are fluids that contain curable components uniformly mixed with a liquid medium. The curable components may include solid particles or liquid. Once deposited onto the surfaces, the liquid medium typically evaporates and/or reacts alone or with curable components to leave a solid layer of a functional and/or decorative coating on the article.

Spraying involves moving a stream of the coating material fluid at a high flow rate through a relatively small diameter orifice of the applicator. Typically the nature and concentration of the curable components in the liquid medium is such that the spraying fluid has very high viscosity. Due largely to the generally high viscosity of the spraying fluid in painting and functional coating end use applications, more force than can be developed by portable manual methods is called for to achieve an effective spray for uniform coating.

Spraying of paint and functional coating materials virtually exclusively relies on power-driven or propellant-assisted techniques. Power-driven techniques utilize engine-driven or motor-driven pumps to hydraulically force the coating fluid through the narrow orifice at high pressure. Propellant-assisted techniques can use a compressed gas to mix with the coating fluid in the spray nozzle. As the gas expands during passage through the nozzle, entrained coating fluid atomizes to form droplets that are carried onto the surface being sprayed.

Power-driven and propellant-assisted spray application systems can be inconvenient in situations, for example, where small areas are to be coated or small quantities, especially small amounts of different colors or formulations of coating fluid are used. A practical example is touch-up painting in which a comparatively large coated area has had subsequent damage or was incompletely covered. Only a small surface area needs to be "touched-up" to repair the defect. Power-driven and propellant-assisted spray systems are typically large and employ power sources and auxiliary supplies, such as fuel. Consequently, moving such automated equipment to distant and remote locations, as is often necessary in military utilities, can be difficult and expensive. These paint systems also typically use large quantities of coating material and are not convenient for small area touch-up tasks. Moreover, these systems are reusable and should be thoroughly cleaned after each use. Cleaning has further drawbacks including extra investment of time, effort, personnel, cleaning materials, and the generation of waste. It is thus highly desirable to have a light, portable, manually operable spraying system for applying industrial quality paints and functional coatings. It is further needed to have such a portable, manually operable spraying system that is small enough for convenient application of paints and functional coatings in touch-up end use applications. A single-use, disposable spray application system that does not need cleaning after use is also needed.

The spray application of military equipment, and especially vehicles, with chemical agent resistant coating ("CARC" occasionally referred to herein as a "CARC coating") is a particular end use application of great importance. CARC coating on surfaces of military vehicles is formulated to provide a variety of significant safety and strategic functions. Unlike ordinary protective coatings, a CARC coating is formulated to resist absorption of chemical and biological warfare agents. Consequently, CARC-covered apparatus such as military vehicles and equipment that are exposed to chemical and biological warfare agents can be relatively easily, quickly and thoroughly decontaminated, for example by simple washing.

CARC also provides both visual and non-visual camouflage protection. CARC is pigmented in colors selected to match the visual appearance of the surroundings in traditional manner to camouflage a coated object and thereby hinder detection by visual observation. Additionally, CARC composition includes infrared radiation ("IR") signature management components. This aspect of CARC enables military equipment and vehicles to absorb and reflect IR radiation similarly to the natural surrounding environment. CARC-covered, synthetic equipment and vehicle surfaces mimic the background environmental IR signature and thus are more difficult to detect when scanned by extra-visual, IR radiation surveillance instruments. For example, a vehicle with a CARC coating that reflects woodland IR characteristics will be difficult to identify by IR surveillance sensor scanning when located in a heavily wooded environment. Furthermore, equipment effectively covered by CARC will have enhanced protection from many missile guidance systems that use IR signature as a primary target tracking method. Surfaces without CARC coating or with chipped, scuffed, scratched or other CARC coating defects will stand out from the surroundings and thus can be more readily detected by IR sensing surveillance instruments. A proper and full-coverage CARC surface enhances detection avoidance and is critical to survivability of personnel and strategic effectiveness in combat situations.

Military vehicles and equipment often experience rough treatment in service and their surface coatings are very frequently damaged when deployed in the field. Military and some civilian field locations are often distant from paint re-application stations. There is thus an important need to have a touch-up CARC coating application system suitable and available for use in remote military field service locations. Because field service locations can be primitive and lack mechanical and electrical infrastructure, automated spray paint application technology may not be practical in the field. A further need exists to provide light weight, portable and manually operable touch-up application system for CARC coatings that does not rely on a well-outfitted power and mechanical support system. Even in secure, well-powered, properly controlled and equipped coating stations, minor defects in CARC application requiring touch-up repairs can occur. A self-contained, portable, light weight touch-up CARC application system adapted for applying small amounts of CARC to repair small area defects in all locations is desirable to have.

It follows that CARC compositions are carefully formulated to provide the various functional features described above. It is very important that the CARC coating fluid being applied is of composition uniformly within critical specifications. CARC compositions, among other things, can include fine particulate solids dispersed in liquid medium. If not agitated, the heavy particles tend to settle in the coating fluid containers during long storage periods. Re-dispersion of settled solids into a uniform CARC composition in traditional storage containers can be difficult and nearly impossible without effectively intense agitation. The composition is also curable on exposure to ambient atmospheric conditions. If leakage of air or moisture into the CARC fluid containers during storage is permitted, non-uniformity of the composition in the container can easily occur. Storing CARC coating fluid in impermeable vessels with vapor- and liquid-tight seals is imperative. Opening the containers to redistribute settled solids into a uniform dispersion is deemed undesirable. It is extremely important that all CARC fluid applied, regardless of time in storage, has the complete complement of functional characteristics to effectively impart the intended visual and extra-visual camouflage performance. Stability and uniformity of CARC storage and application systems are of great concern.

It is highly desirable to have a portable, light weight CARC spray application system that enables enhanced re-dispersion of the composition uniformly consistent with all specifications after prolonged storage. It is much desired to have a self-contained, portable, manually operable CARC coating fluid spray application system that can easily provide a consistent quality, uniform CARC composition at time of application at remote locations in a touch-up coating repair situation after lengthy standing in storage.

An existing device for applying a touch up CARC coating is shown and described in U.S. Pat. No. 7,338,227, of Bullivant. That applicator uses a two component CARC coating fluid composition that employs mixing the components before application. It also applies the coating fluid via a roller applicator that requires contacting the surface to be coated with the roller. If the surface has acute angle features or if objects on the equipment are position too closely to the surface, the roller may not be able to contact the whole surface and thus will leave bare spots. A sprayed coating can reach crevices and other difficult to contact parts of complex-shaped articles. It is desirable to have a spray applicator that can distribute CARC coating fluid uniformly onto the complete surface.

Aerosol can applicators for paints are known. One such device is sold under the trademark PREVAL® (Chicago Aerosol, LLC). The PREVAL® sprayer unit includes a container with aerosol propellant and a plastic tube to take up the paint. The unit also has threads so that a plastic bottle containing a small quantity of paint may be attached to the PREVAL® sprayer unit. Certain paints can be sprayed as an aerosol from applicators such as this, however, the sprayer unit will not operate when held at an angle greater than 45° and it clogs easily. It has been difficult to use single component, moisture cure CARC coating fluid with a traditional aerosol container applicator. This type of coating cures by reaction with moisture which is difficult to exclude during the filling of aerosol cans.

SUMMARY OF THE INVENTION

The present invention provides a portable, manually operable, trigger-activated pump spray applicator for paints and coating fluids in commercial and military end use applications, especially chemical agent resistant coating (CARC) fluids. It includes an impermeable, preferably rigid-walled container capped by a manual spray pump and single fluid nozzle. The assembly has capability of producing an atomized spray of viscous coating fluids. The applicator includes internal agitators suitable to redisperse solid components of the coating fluid that settle after long-term storage. The agitators include a plurality of small, heavy spheres and a single large, heavy, striker. The inside bottom wall and side wall meet with a concave radius of curvature that matches the radius of the small spheres. The striker has a characteristic dimension of about 10-500% greater than the diameter of the small spheres.

The present invention may be used to apply all types of polymeric coatings for commercial and industrial purposes as well as military applications. It can be used with non-CARC, polymeric coating compositions such as urethane, epoxy, latex, and acrylic.

Accordingly there is provided a manual spray paint application system for spraying a coating fluid onto a substrate, comprising (a) a bottle-shaped container having an impermeable body defined by a flat bottom wall with an oviform perimeter at a lower end of the container, a side wall extending upward from the bottom wall and terminating in a top end defining an opening to receive contents of the container opposite the bottom wall, the side wall being substantially perpendicular to the bottom wall near the lower end, and (b) an agitation system within the container comprising (i) a plurality of freely movable, small spherical balls, and (ii) at least one freely movable striker larger than any of the small spherical balls, in which the bottom wall and side wall join inside the container to form a corner having at every point along the perimeter a circular arc cross section in a plane perpendicular to both the bottom wall and the side wall, the circular arc defined by a radius of curvature, in which the small spherical balls each have a radius equal to the radius of curvature, and in which the at least one striker has a characteristic dimension about 10-500% greater than twice the radius of curvature.

The invention also provides a method of coating a surface of a substrate with a liquid, curable coating fluid comprising the steps of (i) providing a portable spray applicator containing an inventory of the curable coating fluid and having a manually operable, pump sprayer that includes a single-fluid spray nozzle in fluid communication with the curable coating fluid, (ii) manually pumping the curable coating fluid through the spray nozzle, thereby forming a spray of atomized coating fluid, and (iii) directing the spray of atomized coating fluid onto the surface.

There is still further provided a method of making a spray paint application system for spraying a coating fluid onto a substrate, comprising the steps of (a) providing an empty and clean, bottle-shaped container having an impermeable body defined by a flat bottom wall with an oviform perimeter at a lower end of the container, a side wall extending upward from the bottom wall and terminating in a top end defining an opening to receive contents of the container opposite the bottom wall, the side wall being substantially perpendicular to the bottom wall near the lower end, in which the bottom wall and side wall join inside the container to form a corner having at every point along the perimeter a circular arc cross section in a plane perpendicular to both the bottom wall and the side wall, the circular arc defined by a radius of curvature, (b) providing an agitation system consisting of (i) a plurality of small spherical balls, and (ii) at least one striker larger than any of the small spherical balls, in which the small spherical balls each have a radius equal to the radius of curvature, and in which the at least one striker has a characteristic dimension about 10-500% greater than twice the radius of curvature, (c) providing a manual pump sprayer comprising a cover, a dip tube, a pump, a trigger, and an atomizing spray nozzle, in which the dip tube, pump and spray nozzle are in fluid communication and the pump is adapted to force liquid from the dip tube through the spray nozzle by manual activation of the trigger, (d) heating the container, agitation system and pump sprayer to a temperature in the range of about 50° C.-75° C. in an inert gas atmosphere for at least about 20 minutes, (e) placing the agitation system into the container, (f) pouring a uniform composition of curable coating fluid into the container while the container and agitation system are above about 40° C. and are under the inert gas atmosphere, and directly thereafter mounting the pump sprayer onto the container thereby sealing the coating fluid inside the container with a liquid-tight seal, and (g) cooling the spray paint application system to room temperature.

DETAILED DESCRIPTION OF THE INVENTION

Figure 1:
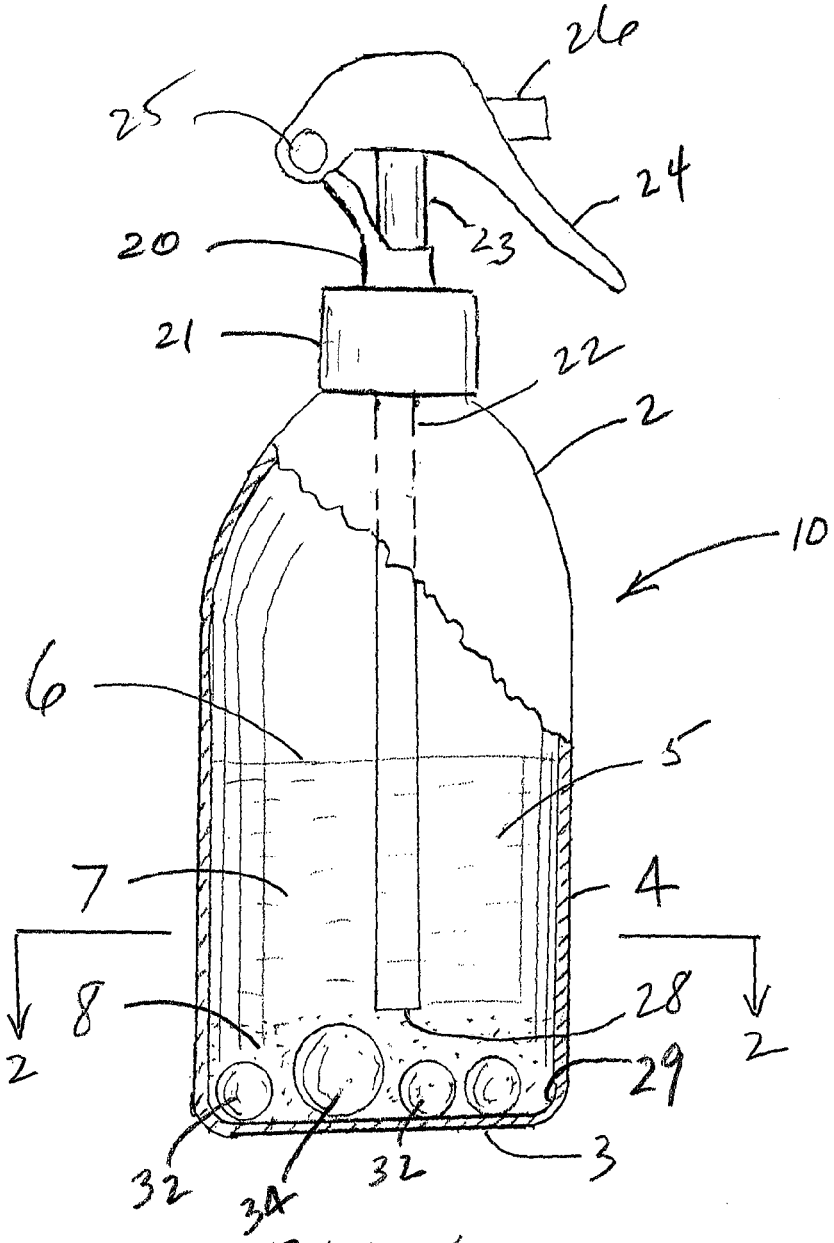
FIG. 1 is a partially section view of a spray paint application system according to an embodiment of this invention.

As used herein the term "oviform" means any of a variety of symmetric and non-symmetric continuous loop geometric shapes including circular, ovular (egg-shape-cross section), curved-cornered rectangular, elliptical, race-track curved, and the like. The term "coating fluid" means a paint or coating composition, including a chemical agent resistant coating ("CARC") composition, that is a liquid, optionally containing fine particle size, discrete solid particles, and which liquid is functional to cure to a finished, solid coating material upon appropriate exposure to cure conditions such as heat, moisture, radiation and the like causing evaporation of fugitive liquid solvent and/or reaction, such as polymerization or cross linking of components of the composition. In the drawings, like parts have the same reference numbers.

Aspects of the novel spray paint application system can be understood with reference to FIG. 1. The spray paint application system includes an applicator and a coating fluid. The lower portion of the applicator 10 is a hollow, preferably bottle-shaped container 2 suitable for holding liquids. Occasionally, the container is referred to herein as a bottle. By "bottle-shaped" is meant that the container has a relatively large volume, inventory-holding lower portion and a narrow upper portion with a mouth at the upper end of the container. The illustrated container has a substantially flat bottom wall 3 and upright side wall 4. The walls are of materials impermeable to gas and liquid and are preferably rigid. Aluminum is preferred. At the top end the container gradually narrows to an opening through which liquid contents can be admitted. This opening is of a form suitable for mating with a pump sprayer 20. For example, the opening can include a male screw thread element adapted to mate with a female screw thread element of the cover 21 of pump sprayer 20.

A representative bottle suitable for use as the container in the novel spray paint application system is seamless drawn 1050A grade aluminum bottle with unlined interior, and polished rolled 28 mm diameter opening part No. AG12040 (Elemental Container, Union, N.J.). This bottle has a single piece, molded polypropylene continuous DIN-42 thread overlying the side wall at the top opening.

The upper portion of the applicator 10 is a pump sprayer 20. A preferred pump sprayer is a single fluid nozzle type apparatus. It utilizes hydraulic pressure of the fluid being sprayed to such that forcing the fluid through an orifice of the nozzle generates effective kinetic energy to atomize the fluid into fine, droplet size. Various nozzle styles can be used, including plain nozzle, shaped nozzle, surface impingement single fluid nozzle, pressure swirl single fluid nozzle, and solid cone single fluid nozzle.

In the single fluid nozzle pump sprayers employed by this invention, the sole motivating medium for formation of the spray droplets is hydraulic pressure of the coating fluid itself causing the fluid to move through the orifice of the nozzle. Such single fluid nozzle sprayers do not utilize air or any other atomizing propellant. Hence, the novel spray applicator and method of spraying may be characterized as being airless and non-propellant assisted.

Preferably the pump sprayer is manually operable. Manual operability provides portability, simplicity and light weight in view that an external power source and related pressure development elements are not used. Any type of manual pump can be used. For example, vertical finger pump action type pumps can be used such as a Mark VII® sprayer (Mead Westvaco, Richmond, Va.) or McKernan Packaging Clearinghouse (Reno, Nev.) spray dispenser item No. HF-22771 (by Rexam PLC, London). However, great preference is given to a trigger activated manual pump. Trigger action affords greater control of spray direction while having an ergonomically adapted design to more easily develop greater pumping pressure that is desired to effectively atomize viscous paint and coating fluids. Examples of trigger activated manual pump sprayers that are suitable for use in this invention are the Mead Westvaco Calmar sprayers available from McKernan Packaging Clearinghouse as items No. HT-22210 and No. HT-18610, and trigger sprayer Item No. 0240004 (Parish Maintenance Supply Corp., Syracuse, N.Y.).

Typical features in common with trigger action pump sprayers are a cover 21 adapted to make a fluid tight connection of the sprayer to the container 2, a dip tube 22, a pump 23, a trigger 24, and spray nozzle 26. Depressing the trigger pivots the trigger 24 about axis of pin 25 that forces pump 23 downward to develop a burst of spray from nozzle 26 and to compress a spring means, not shown. Releasing the trigger permits the spring means to expand and raise the pump to original elevation.

A vapor tight seal between the bottle and the pump sprayer assembly is achieved using a closure system. A representative closure system is the cylindrical, low density polyethylene composition No. 028PLUG (Elemental Container, Union, N.J.) having 28 mm×13.5 mm insertable depth and 5.5 mm seal brim.

When the application system is fully assembled and in condition to spray, the bottle contains an inventory of coating fluid 5 that defines an internal liquid surface 6. Dip tube 22 extends deeply into the container such that an optimum amount of coating fluid can be accessible to the pump by way of tube inlet 28. It is contemplated that filled spray applicators will be maintained for long periods of time in storage at warehouse facilities or field installations in readiness to be consumed. During extended storage periods, coating fluids composed of solid particles dispersed in a carrier liquid or of non-miscible liquid components of different densities, can be expected to settle to separate phases due to gravity. The settled condition is illustrated in FIG. 1 by a predominantly low density, solids-free liquid 7 positioned above dense particles, slurry or higher density liquid 8. In most end use applications, including merely decorative paint applications, it is desirable to dispense a uniform composition of coating fluid. For applying CARC compositions, it is imperative to have a high degree of composition uniformity. This is to assure that all areas to which spray is applied will have adequate benefit of the functional properties of the CARC layer.

Figure 2:
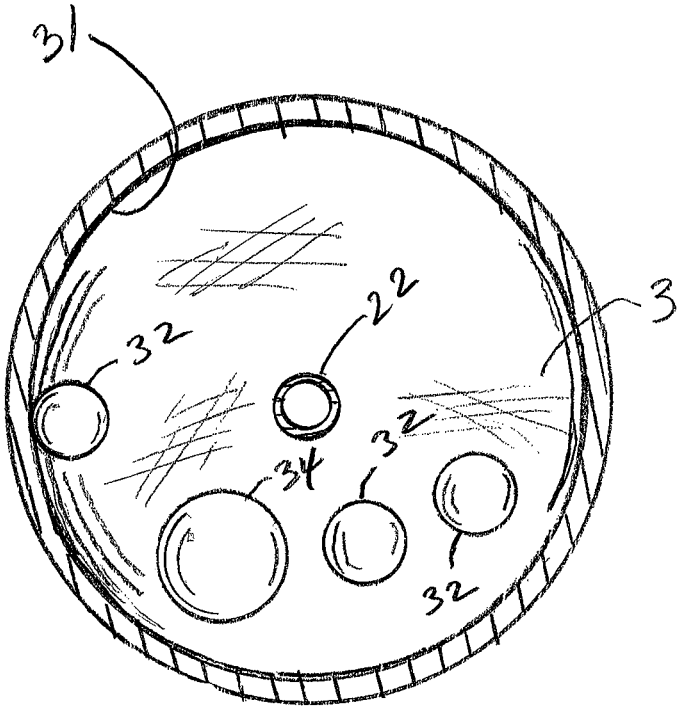
FIG. 2 is a section view of the spray paint application system of FIG. 1 taken along line 2-2.

The novel spray paint application system has various features that enable a user to quickly, easily and manually redistribute a non-homogeneous coating fluid in the bottle to a uniform composition. Firstly, the shape of the lower end of the container provides the bottom wall 3 with an oviform perimeter 31 (FIG. 2). Thus there are no discontinuities in the continuous curve of the perimeter where settled particles could not be dislodged by agitation. That is, the agitators can access all of the material originally placed in the container such that re-dispersion of settled components provides the specified coating fluid composition.

In the illustrated embodiment, the perimeter is circular. Also, the corner 29 (FIG. 1) where vertical side wall 4 joins bottom wall 3 has a circular radius of curvature. The spray applicator includes a combination of a plurality of agitation balls 32 and 34. The agitation balls are dense, smooth-surfaced granules and are chemically inert with the coating fluid. The agitation balls are freely-moving within the container. That is, they are not physically connected to the walls of the container and are free to move about. Indeed, it is intended that by shaking the spray applicator, especially in an orbital motion about a vertical axis, i.e., parallel to the axis of the dip tube as seen in FIG. 1, will cause the balls to move about on the inside surface of bottom wall 3. It is also, possible and suggested to shake the spray applicator in randomly variable directions having a vertical component. Such shaking should cause the balls to randomly move throughout the volume of the container. The object of this motion is to agitate the liquid and redistribute any high density coating fluid components that might have settled on and near the bottom wall and thereby form a uniformly disperse liquid curable coating fluid within the container. Preferably, vigorously shaking the spray applicator for at least 30 seconds, more preferably for at least 1 minute, and most preferably for at least 2 minutes should effectively redisperse heterogeneous components to produce within the spray applicator a uniformly dispersed curable coating fluid.

The shape and size of the balls is important to achieving the desired agitation effect. There is a plurality of balls 32, occasionally referred to herein as "smaller" balls. Preferably the number of small balls is 2 or 3. Each of smaller balls 32 is spherical. The diameter of the smaller balls 32 is substantially the same as twice the radius of curvature. Thus the convex curvature of the surface of each smaller ball 32 matches and mates with the concave curvature of the corner 29. There is present at least one object 34, occasionally referred to herein as a "striker" or a "larger" ball. The shape of the striker is not critical, although the surface should be smooth and not have deep indentations or narrow crevices into which components of the coating fluid could lodge. For example, the striker can be egg-shaped. Preferably the striker is also a sphere.

The striker will have a characteristic dimension defined by the diameter of the smallest circular hole through which the striker will pass. Thus for a spherical striker, the characteristic dimension is the striker diameter. The characteristic dimension of the striker should be greater than the diameter, i.e., twice the radius, of the smaller balls. If the striker size is too large it will be unable to contact and interact with the small balls to achieve optimum agitation. This can occur for example with a striker so large that the striker is constrained by the bottom wall and side wall which prevent the striker from protruding sufficiently far into the corner 29 to contact a small ball positioned there. Preferably the characteristic dimension of the striker should be about 10-500% greater than the diameter of the small balls.

The balls should be denser than all of the components of the coating fluid to assure that the balls position themselves at the bottom of the container in contact with the inside surface of the bottom wall 3. Preferably the balls are metal and steel is preferred. An example of small balls suitable for use are 7.9375 mm diameter, high density carbon steel, spherical ball bearings (Frantz Manufacturing Co., Sterling Ill.).

The purpose of the balls in use is to dislodge settled components 8 of the coating fluid and to facilitate mixing with lighter, usually liquid components 7. Primarily the smaller balls function by moving through the low region of settled components 8 and thereby stirring the heavier components upward from the bottom wall. Once dislodged, vigorous shaking of the spray applicator accomplished readily by hand should adequately agitate the components such that a uniform dispersion of the components is re-created without excessive effort. To some extent, the striker performs the same agitation and dispersion function.

As mentioned, the radius of the smaller balls is equal to the radius of curvature of the container corner feature. This relationship coupled with the oviform geometry of the bottom wall perimeter, is designed such that the smaller balls can completely sweep the settled components from the bottom and especially near the walls of the container. In a practical sense, the size of the smaller balls is thus in the range of about 0.12-0.5 inches in diameter. After extended storage time and settling, the smaller balls can become embedded in a thick, heavy layer of the dense coating fluid components. Given the limited dimensions of the smaller balls, they may not have the mass to develop momentum with shaking to free themselves from a sludge of settled components. A main purpose of the striker is to forcefully careen into and dislodge smaller balls that can become stuck in coating fluid components settled at the bottom of the container. The striker is much larger than the smaller balls and will have a commensurately greater mass. Consequently, striker should on shaking of the spray applicator, easily become free from settled coating fluid. Also force of collision of the striker with the smaller balls should break the latter from stationary entrapment and free the smaller balls to accomplish the redistribution of the settled components in the lighter fluid components. A preferred striker is a 14.2875 mm diameter high density carbon steel, spherical ball bearing (Frantz Manufacturing Co., Sterling, Ill.).

The novel spray applicators may be used in a wide variety of polymeric coatings in other military applications as well as for commercial and industrial uses. They work well with polymeric coatings such as urethane, epoxy, latex, acrylic, etc., and in water or solvent dispersions.

Many coating fluid systems are composed of a single-part composition. These are components that remain fluid until exposed to an external curing stimulant such as ambient oxygen, moisture, heat or radiation. Such single-part compositions can be placed in the novel spray applicators, kept sealed for extended storage, agitated to redistribute the coating fluid composition, and sprayed onto the target surface. The wet-coated target surface is then treated to activate the coating fluid and thereby form a solid layer on the surface. For example, the wet coat can be subjected to heat to evaporate a volatile liquid carrying component to leave a solid layer on the surface.

The novel spray applicators can also be used with co-reactive, i.e., two-part coating fluids. Such fluid systems have multiple fluids, typically two, that react with each other spontaneously to form the a solidified, finished coating. The co-reactive fluids must be segregated from each other until immediately before being applied to the surface. Two part urethane and epoxy based compositions are representative examples. To use the novel spray applicator with a co-activating composition coating fluid a step-wise procedure is used. A spray paint application system according to this invention, for example as shown in FIG. 1, can be provided containing a first part component of the multi-part co-reactive coating fluid system. This applicator can be pre-packaged, i.e., pre-filled well in advance with the first part component, sealed, stored and then retrieved from storage. Alternatively, an empty spray applicator can be opened and the first part component added just a short time before use. The applicator with the first part component is then opened by removing the spray pump. The second part component of the coating fluid system can then be admitted into the container through the opening. After quickly re-capping the container with the spray pump, the sealed applicator should be vigorously shaken in orbital and vertical directions causing the agitator balls to mix the first and second part components thoroughly. The mixed components will begin to co-react on mutual contact. Such fluid systems typically have a specified working pot life during which they will remain fluid. The pump of the applicator should be manually operated to spray the mixed components onto the target surface before expiration of the pot life.

Although mainly directed to spraying surfaces with paint or coating fluids such as CARC using a portable, manual spray applicator, the agitation system of this invention can also be applied to power-assisted spraying. This is achieved by attaching to a power spray head, a preferably bottle-shaped container having smaller balls and striker inside. Examples of powered, air-assist paint sprayers that may be used for this purpose are the models 62 and 63 paint guns (Paasche Airbrush Co., Chicago, Ill.).

Additional aspects of this invention are described in US published patent application 20110258825 published Oct. 27, 2011 (Ser. No. 13/135,281, filed Jun. 30, 2011), application Ser. No. 13/065,179 filed Mar. 16, 2011, and application Ser. No. 13/065,178 filed Mar. 16, 2011. The entire disclosures of all U.S. patents and patent applications identified in this application are hereby expressly incorporated herein by reference.

The novel spray paint application system advantageously can be prepared in batch quantities well in advance of use. The procedure for assembling an individual application system includes providing a clean, dry empty bottle, a spray pump and nozzle assembly and agitator pieces. Prior to filling the bottle, all application system parts are heated for at least about 20 minutes in an oven at 50° C. to about 75° C. to dry and warm them. The bulk, i.e., as-produced" coating fluid, preferably a CARC coating composition, is intensely agitated in a sealed supply container for at least 10 minutes with a motor-driven paint shaker to uniformly disperse the various components. The shaken supply container is moved to a chamber, such as a glove box, having an oxygen-free, dehumidified, inert gas atmosphere where all transfer and exposure of fluid takes place. Preferably the inert gas is nitrogen. The bulk coating composition is diluted with appropriate compatible organic solvent effectively to produce a coating fluid with preselected viscosity. The preselected viscosity is chosen to enable the coating fluid to atomize when pumped through the spray nozzle thereby forming a mist of aerosol particles ideally sized to uniformly cover a substrate surface being painted.

All application system parts as needed during the system assembly process are moved directly from the drying oven to the inert atmosphere with minimum practicable exposure to ambient atmospheric conditions. Agitator spheres and striker are inserted into the bottle before adding fluid. The desired quantity of dilute coating fluid is poured into the spray applicator bottle. The spray pump and nozzle assembly with the dip tube inserted into the bottle are quickly installed onto the bottle to produce a vapor tight seal. If the agitators are dropped into the bottle after filling with fluid, some fluid could splash out of the then open container. Optionally, the dip tube is filled with diluted coating fluid prior to installing the spray pump and nozzle assembly. This "tube-priming" step can improve stability by displacing any humid, oxygen-containing gas residual in the tube bore at time of assembly. Tube-priming can be performed by squeezing the trigger repeatedly while submerging the tube inlet below the surface of a supply of coating fluid or solvent. When proper care is taken to maintain all assembly steps under inert gas blanketing, the tube-priming step may have negligible benefit and can be eliminated. In another optional step, the individual bottles are purged with inert gas immediately prior to filling with coating fluid. This is accomplished by inserting a tube carrying dry nitrogen deep into the open bottle and flushing the vapor space inside the bottle for a few minutes.

For optimum coating fluid stability in the application system, it is important to add the contents and close the container while all the parts for the assembly are still warm from heating in the drying oven and are above room temperature, preferably above about 40° C. This procedure captures inert gas in the container above the liquid surface at elevated temperature. The filled and sealed container can be removed from the inert gas environment and placed in storage for later shipment and use. In due course the filled and sealed containers are allowed to naturally cool to ambient temperature. Because the entrapped gas contracts on cooling, a slight vacuum pressure is established inside the container. It is believed that storage under the slight vacuum provides greater stability and longer shelf life to the product than occurs with either atmospheric or higher than atmospheric pressure in the container. This is unusual because a sealed container under vacuum is expected to draw contamination inward and a pressurized container should be a better barrier against foreign gas intrusion. The spray paint application system is held within the inert gas atmospheric environment at least until the cover is sealed to the container.

Preferably each spray paint application system is individually wrapped in a heat-shrinkable bag of vapor barrier film and the bag is heated to shrink the film tightly around the applicator. The heat shrink film enhances the resistance to penetration of air and moisture into the container and it protects the cover from inadvertently being opened prior to use and the trigger from accidentally being squeezed while the applicator is being transported. Moreover, shrink-wrapping provides tamper resistance and evidence of an opened applicator.

Although specific forms of the invention have been selected in the preceding disclosure for illustration in specific terms for the purpose of describing these forms of the invention fully and amply for one of average skill in the pertinent art, it should be understood that various substitutions and modifications which bring about substantially equivalent or superior results and/or performance are deemed to be within the scope and spirit of the following claims.

What is claimed is:

1. A method of coating a surface of a substrate with a liquid, curable coating fluid comprising the steps of (i) providing a portable spray applicator containing an inventory of the curable coating fluid and having a manually operable, pump sprayer that includes a single-fluid spray nozzle in fluid communication with the curable coating fluid, (ii) manually pumping the curable coating fluid through the spray nozzle, thereby forming a spray of atomized coating fluid, and (iii) directing the spray of atomized coating fluid onto the surface in which the spray applicator further comprises (a) a bottle-shaped container having an impermeable body defined by a flat bottom wall with an oviform perimeter at a lower end of the container, a side wall extending upward from the bottom wall and terminating in a top end defining an opening to receive contents of the container opposite the bottom wall, the side wall being substantially perpendicular to the bottom wall near the lower end, and (b) an agitation system within the container comprising (i) a plurality of freely movable, small spherical balls, and (ii) at least one freely movable striker, in which the bottom wall and side wall join inside the container to form a corner having at every point along the perimeter a circular arc cross section in a plane perpendicular to both the bottom wall and the side wall, the circular arc defined by a radius of curvature, in which the small spherical balls each have a radius equal to the radius of curvature, and in which the at least one striker has a characteristic dimension about 10-500% greater than twice the radius of curvature.

2. The method of claim 1 in which the curable coating fluid is a chemical agent resistant coating composition.

3. The method of claim 2 in which prior to pumping the curable coating fluid through the spray nozzle, the inventory of the curable coating fluid within the spray applicator is in contact with an inert gas atmosphere at a pressure lower than ambient atmospheric pressure.

4. The method of claim 1 which further comprises the step of manually shaking the spray applicator effectively to cause the small spherical balls and the striker to move about within the container and thereby agitate the curable coating fluid therein.

5. A method of making a spray paint application system for spraying a coating fluid onto a substrate, comprising the steps of (a) providing an empty and clean, bottle-shaped container having an impermeable body defined by a flat bottom wall with an oviform perimeter at a lower end of the container, a side wall extending upward from the bottom wall and terminating in a top end defining an opening to receive contents of the container opposite the bottom wall, the side wall being substantially perpendicular to the bottom wall near the lower end, in which the bottom wall and side wall join inside the container to form a corner having at every point along the perimeter a circular arc cross section in a plane perpendicular to both the bottom wall and the side wall, the circular arc defined by a radius of curvature, (b) providing an agitation system consisting of (i) a plurality of small spherical balls, and (ii) at least one striker larger than any of the small spherical balls, in which the small spherical balls each have a radius equal to the radius of curvature, and in which the at least one striker has a characteristic dimension about 10-500% greater than twice the radius of curvature, (c) providing a manual pump sprayer comprising a cover, a dip tube, a pump, a trigger, and an atomizing spray nozzle, in which the dip tube, pump and spray nozzle are in fluid communication and the pump is adapted to force liquid from the dip tube through the spray nozzle by manual activation of the trigger, (d) heating the container, agitation system and pump sprayer to a temperature in the range of about 50° C.-75° C. in an inert gas atmosphere for at least about 20 minutes, (e) placing the agitation system into the container, (f) pouring a uniform composition of curable coating fluid into the container while the container and agitation system are above about 40° C. and are under the inert gas atmosphere, and directly thereafter mounting the pump sprayer onto the container thereby sealing the coating fluid inside the container with a liquid-tight seal, and (g) cooling the spray paint application system to room temperature.

6. The method of claim 5 in which the dip tube is filled with an inert solvent prior to mounting the pump sprayer onto the container.

7. The method of claim 5 in which the coating fluid is a chemical agent resistant coating composition.

* * * * *